US007407308B2

(12) United States Patent
Harnischmacher

(10) Patent No.: US 7,407,308 B2
(45) Date of Patent: Aug. 5, 2008

(54) LAMP

(75) Inventor: Friedhelm Harnischmacher, Menden (DE)

(73) Assignee: Cooper Crouse-Hinds GmbH (DE)

( * ) Notice: Subject to any disclaimer, the term of this patent is extended or adjusted under 35 U.S.C. 154(b) by 588 days.

(21) Appl. No.: 10/343,964

(22) PCT Filed: Jul. 27, 2001

(86) PCT No.: PCT/EP01/08716

§ 371 (c)(1),
(2), (4) Date: Jul. 25, 2003

(87) PCT Pub. No.: WO02/12786

PCT Pub. Date: Feb. 14, 2002

(65) Prior Publication Data

US 2004/0032738 A1 Feb. 19, 2004

(51) Int. Cl.
*F21V 7/00* (2006.01)

(52) U.S. Cl. ..... 362/362; 362/376; 362/377

(58) Field of Classification Search ..... 313/312; 362/390, 376, 377, 378; 439/9, 10; 315/56
See application file for complete search history.

(56) References Cited

U.S. PATENT DOCUMENTS 3,673,424 A 6/1972 Phlieger, Jr.
4,112,485 A * 9/1978 Sutter ..... 362/369
4,186,432 A 1/1980 Hamacher
4,257,765 A * 3/1981 Potter et al. ..... 431/360
4,885,670 A * 12/1989 Baake ..... 362/400
6,000,819 A * 12/1999 Graber et al. ..... 362/376
6,043,853 A * 3/2000 Shimazaki et al. ..... 348/625
6,095,662 A 8/2000 Burroughs et al.
6,271,629 B1 * 8/2001 Pace et al. ..... 315/56

FOREIGN PATENT DOCUMENTS

DE 87 01 424.6 3/1987
DE 41 38 942 A1 6/1992
FR 1347231 3/1964

* cited by examiner

*Primary Examiner*—Anabel M Ton
(74) *Attorney, Agent, or Firm*—Fish & Richardson P.C.

(57) ABSTRACT

A luminaire (1) comprises a luminaire housing (2) having at least one light exit opening (3), and further comprises an explosion-proof illuminant (4) consisting of at least a lamp (5), a base (6) and a lamp envelope (7), and housing contacts (8) in the luminaire housing (2) for supplying the illuminant with electric energy. In order to facilitate the production of such a luminaire and in order to design said luminaire also in such a way that it is variable and suitable for use with essentially all kinds of lamps, and at least partially reusable, the lamp (5) and the base (6) are arranged in the lamp envelope (7) which is implemented in the pressure-resistant-encapsulation or increased-safety ignition protection mode and which is provided with envelope contacts (9) that are accessible from outside, said envelope contacts (9) being used for connection to the housing contacts (8) and being electrically connected to the base (6).

30 Claims, 2 Drawing Sheets

LAMP

The present invention relates to a luminaire comprising a luminaire housing having at least one light exit opening, and further comprising an explosion-proof illuminant consisting of at least a lamp, a base and a lamp envelope, and housing contacts in the luminaire housing for supplying the illuminant with electric energy.

Such a luminaire is known e.g. from DE 41 38 942. In the known luminaire the explosion-proof illuminant consists of e.g. a halogen lamp used as a lamp, an envelope bulb as a lamp envelope and a bowl-shaped base. The envelope bulb and the lamp have one of their ends inserted in the bowl-shaped base, where they can be secured in position by a curable material. The base is provided with contact projections on the outer side thereof, said contact projections being electrically connected to the lamp and being used for contacting complementary housing contacts in the luminaire housing of the luminaire.

The production of such a known illuminant is comparatively complicated, since both the lamp envelope and the lamp are secured in position in the base with their electric contacts. In addition, the use of a base that is adapted to be screwed in necessitates, during insertion of the illuminant, an additional rotary movement for screwing the base into a complementary mating contact element. Furthermore, difficulties will arise in the case of this known prior art, if a lamp which is already provided with a base is to be used. Normally, such a lamp is, moreover, only suitable for a small wattage.

It is therefore the object of the subject matter of the application to improve a luminaire of the type mentioned at the start in such a way that said luminaire is less difficult to produce and simultaneously variable and suitable for use with essentially all kinds of lamps, and at least partially reusable.

In connection with the features of the generic clause of claim 1, this object is achieved by the features that the lamp and the base are arranged in the lamp envelope which is implemented in the pressure-resistant-encapsulation or increased-safety ignition protection mode and which is provided with envelope contacts that are accessible from outside, said envelope contacts being used for connection to the housing contacts and being electrically connected to the base.

According to the present invention, it is no longer necessary to arrange the lamp envelope and the lamp and the electric contacts thereof in a separate base, where the lamp envelope and respective parts of the lamp have to be secured in position by means of a curable material. In addition, it is essentially possible to use all kinds of lamps with an associated base, such as incandescent lamps, high-pressure vapour lamps, metal vapour lamps, compact fluorescent lamps, halogen lamps, single-pin/bipin or four-pin fluorescent lamps and the like. According to the present invention, the whole lamp with the base or with a contact element corresponding to a base, cf. fluorescent lamps, is enclosed by the lamp envelope. The envelope contacts are arranged directly on the lamp envelope, said envelope contacts being, on the one hand, electrically connected to the base and, on the other hand, adapted to contact the housing contacts in the luminaire housing.

The solution according to the present invention allows a simple exchange of lamps, without a heavy weight of the luminaire or large-volume, pressure-resistant spaces in the luminaire being necessary. In addition, when opening the luminaire, it is no longer necessary to wait until hot locations in the interior of the luminaire have cooled down to e.g. room temperature so as to permit a safe exchange of the lamp in areas where there is danger of explosion. Instead, the luminaire can be opened at any time and the illuminant or rather the lamp envelope can be removed subsequently. In particular the lamp envelope can be reused.

The lamp envelope can be produced from different materials which are suitable for the ignition protection mode in question, such as glass-fibre reinforced polyester, polycarbonate, aluminium, cast light alloy or the like; a sufficient illumination by the lamp can be guaranteed in that the lamp envelope is implemented such that is it transparent to light at least on the side facing the light exit opening.

In accordance with one embodiment, the lamp envelope can consist of borosilicate glass at least in the transparent area thereof.

In order to optimize the light yield of the lamp, the luminaire housing can have a reflector on the side facing the light exit opening and/or the lamp envelope can have a reflector on the side located opposite the light exit opening.

As has already been mentioned at the beginning, a lamp envelope can be implemented such that it is able to accommodate lamps of different kinds, in particular lamps of different sizes and/or wattage.

In order to be able to use e.g. the lamp envelope as a replacement element, as a set of modules in a type program, or for the purpose of adapting a luminaire to requirements that have to be satisfied for explosion-proof use, the illuminant and especially the lamp envelope can be implemented as a separately manipulatable lamp module which is suitable at least for releasable insertion in the luminaire housing and which has predetermined outer dimensions at least in the area of the envelope contacts for contacting the complementary housing contacts. On the basis of this structural design, it is, for example, possible to remove a lamp module from the luminaire and to replace it directly by another lamp module, which may perhaps be equipped with a different kind of lamp, without further retrofitting of the luminaire being necessary. In addition, the lamp modules can e.g. be replaced by respective non-explosion-proof illuminants, when the luminaire is not intended to be used in an explosion-proof area.

In order to reduce the volume of the lamp envelope as far as possible and in order to permit a uniform heat distribution between the lamp and the lamp envelope, the shape of the lamp envelope can be adapted to the shape of the lamp.

For establishing a reliable and safe electric connection between the luminaire and the illuminant, it can additionally be considered to be advantageous when the envelope contacts and/or the housing contacts are implemented in the pressure-resistant-encapsulation or the increased-safety ignition protection mode.

The space between the lamp envelope and the lamp can be evacuated at least partially. It is also possible to fill this space with a gas, such as air, nitrogen or the like. By means of such a gas, explosive mixtures can be prevented from coming into contact with the hot surface of the lamp before said hot surface has cooled down to a sufficient extent.

As has already been mentioned, the illuminant is adapted to be manipulated separately, especially as a lamp module, and can be used for upgrading non-explosion-proof luminaires to explosion-proof luminaires for use in luminaires of the increased-safety ignition protection mode and of the pressure-resistant-encapsulation protection mode. It follows that the present invention also relates to a lamp body or lamp envelope of the type especially described hereinbefore, which is implemented as a lamp module in the pressure-resistant-encapsulation or increased-safety ignition protection mode, said lamp module having arranged therein a lamp and a lamp base and being provided with envelope contacts or module contacts which are accessible from outside and which are electrically connected to said lamp base, wherein the lamp module is adapted to be releasably fixed in a luminaire housing of a luminaire.

In the following, advantageous embodiments of the present invention will be explained in detail on the basis of the figures enclosed as drawings, in which.

Figure 1:
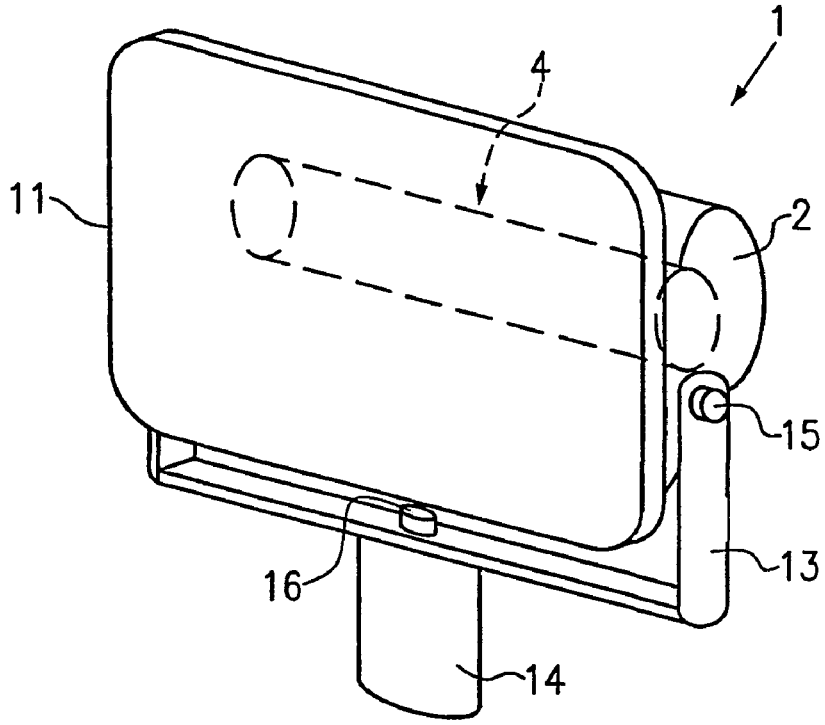
FIG. 1 shows a perspective view of a luminaire having a lamp envelope inserted therein.

FIG. 1 shows a perspective view of a luminaire 1 according to the present invention. This luminaire has a luminaire housing 2 having a bowllike shape. An open side or light exit opening 3, cf. also FIG. 2, of the luminaire housing 2 is covered by a protective glass cover 11. In the interior of the luminaire housing 2 an illuminant 4 is arranged.

The luminaire housing 2 is supported on a fastening bow 13 in such a way that it is pivotable about a horizontal pivot shaft 15. The fastening bow 13 is adapted to be pivoted on a pillar mount 14 about an essentially vertical pivot shaft 16.

Figure 2:
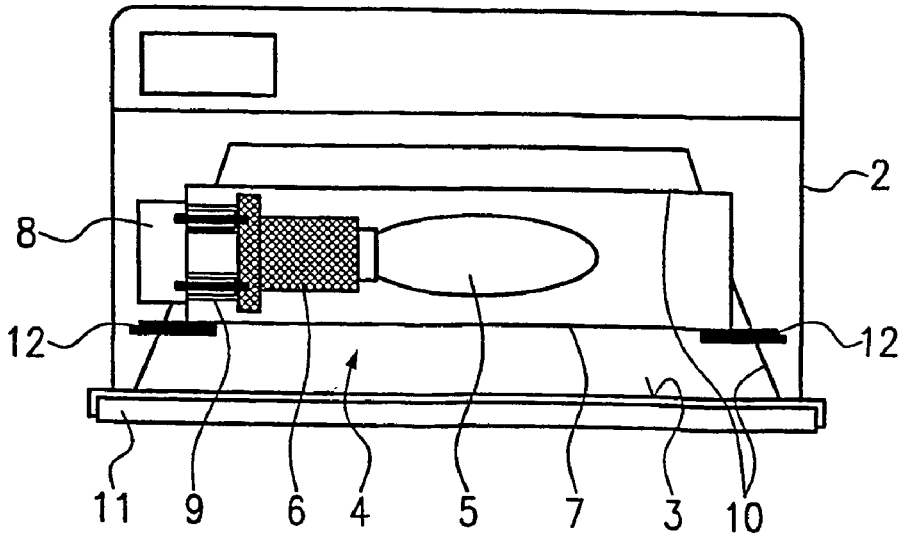
FIG. 2 shows a section through the luminaire according to FIG. 1 along a horizontal plane.

FIG. 2 shows a section through the luminaire 1 according to FIG. 1 in a horizontal plane. Additional means, such as lighting electronics, connecting terminals or the like, are arranged on the luminaire housing 2 or in said luminaire housing; these means have here been omitted for the sake of simplicity.

Within the luminaire housing 2, a reflector 10 is normally arranged, said reflector 10 reflecting, preferably in the direction of the light exit opening 3, light generated by a lamp 5. The lamp 5 is provided with a suitable lamp base 6 and is arranged within a lamp envelope 7; these components form the illuminant 4, cf. FIG. 1. The lamp envelope 7 encompasses the lamp 5 and the lamp base 6. In addition, the lamp envelope 7 is provided with envelope contacts 9 which are accessible from outside. In the embodiment shown, these envelope contacts 9 are implemented as female contacts into which housing contacts 8 can be inserted for supplying electric energy to the lamp 5, said housing contacts 8 being implemented as contact pins 8. The female contacts and the contact pins can be implemented in the pressure-resistant-encapsulation or the increased-safety ignition protection mode.

The envelope contacts 9 are electrically connected to the lamp 5 via the lamp base 6 of said lamp.

The illuminant 4 and the lamp envelope 7, respectively, are adapted to be inserted into the luminaire housing 2 especially through the light exit opening 3, and in said luminaire housing 2 they are releasably secured in position by means of the holder 12. When the lamp envelope 7 is inserted into and fixed within the luminaire housing 2, the electric connection between the housing contacts 8 and the envelope contacts 9 is established simultaneously.

Figure 3:
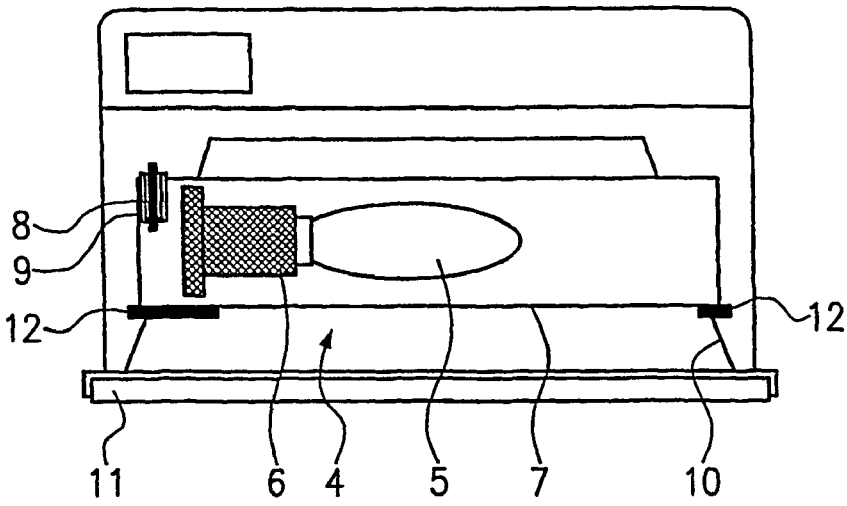
FIG. 3 shows a section analogous that of FIG. 2 through a second embodiment according to the present invention.

FIG. 3 shows a further embodiment according to the present invention in a section analogous to the section of FIG. 2. This embodiment differs from the embodiment according to FIG. 2 especially insofar as the housing contacts 8 and the envelope contacts 9 are arranged in a different way.

Whereas the envelope contacts 9 according to FIG. 2 are arranged on one longitudinal end of the lamp envelope 7, they extend laterally to the lamp envelope in the embodiment according to FIG. 3; also the housing contacts 8 are arranged accordingly.

As for the rest, reference is made to the description of the embodiment according to FIG. 2.

Figure 4:
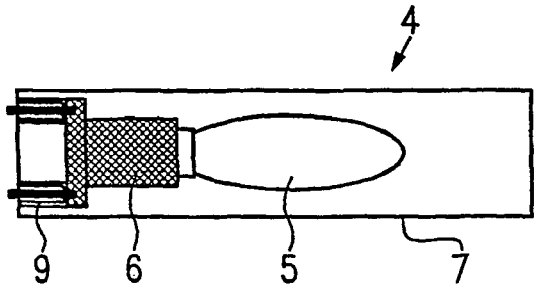
FIG. 4 shows a representation of an illuminant according to the present invention which is adapted to be inserted in a luminaire.

In FIG. 4, the illuminant 4 is shown alone as a separately manipulatable lamp module. The structural design of the lamp module corresponds to that of the illuminant 4 according to FIG. 2. The lamp module, which comprises the lamp envelope 7, the lamp 5, the base 6 and the envelope contacts 9, has dimensions of such a nature that it can be inserted in a type program of luminaires as a replacement element or as a subassembly element; the module and the illuminant 4, respectively, can have arranged therein different lamps 5.

Figure 5:
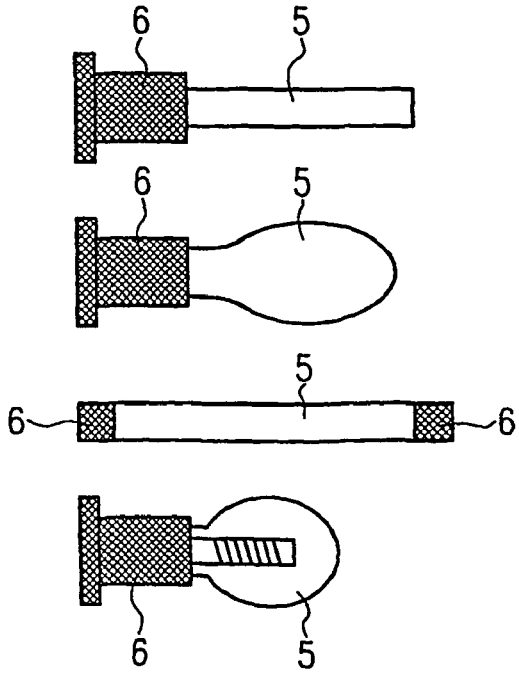
FIG. 5 shows different embodiments of lamps with a base.

Examples of different lamps 5 with different bases 6 are shown in FIG. 5. The lamps that can be used are single-pin/bipin or four-pin fluorescent lamps, halogen lamps, compact fluorescent lamps, incandescent lamps, high-pressure vapour lamps, metal vapour lamps or the like. The bases 6 correspond to the respective bases used for the various lamps, cf. in this respect e.g. the bases 6 arranged on either side of a fluorescent lamp.

According to the present invention the protective measures required in the explosion-proof area are limited to the built-in units to be protected, whereby a small and light design is obtained. In principle, only the illuminant 4 is implemented in the pressure-resistantencapsulation or increased-safety ignition protection mode. It is not necessary to observe cooling times for an exchange of lamps in the case of the present invention because the whole encapsulated lamp module is exchangeable. The lamp module need only be opened in the workshop, i.e. in an area where there is no danger of explosion.

The lamp modules can be used as replacement modules and as a set of modules in a type program. The lamp module according to the present invention additionally offers the possibility of adapting existing luminaires to the requirements that have to be satisfied for explosion-proof use or of retrofitting luminaires which are no longer used in explosion-proof areas by replacing the lamp module by a conventional lamp.

The invention claimed is:

1. A luminaire comprising:

a luminaire housing having at least one light exit opening;

an explosion-proof illuminant consisting of at least a lamp, a base, and a lamp envelope encompassing the lamp and the base; and housing contacts in the luminaire housing for supplying the illuminant with electric energy, wherein:

the lamp and the base are arranged in the lamp envelope which is provided with envelope contacts that are accessible from outside the lamp envelope, the envelope contacts are used for connection to the housing contacts and are electrically connected to the base, and the lamp envelope has predetermined outer dimensions at least in the area of the envelope contacts such that the lamp envelope is sized and configured to accommodate lamps of different sizes.

2. A luminaire according to claim 1 wherein the lamp envelope is implemented such that it is transparent to light at least on a side facing the light exit opening.

3. A luminaire according to claim 2 wherein the lamp envelope consists at least partially of borosilicate glass.

4. A luminaire according to claim 2 wherein the luminaire housing has a reflector on the side facing the light exit opening.

5. A luminaire according to claim 4 wherein the illuminant is implemented as a manipulatable lamp module and the lamp envelope is suitable for releasable insertion in the luminaire housing and has predetermined outer dimensions at least in the area of the envelope contacts.

6. A luminaire according to claim 5 wherein the shape of the lamp envelope is adapted to the shape of the lamp.

7. A luminaire according to claim 6 wherein the envelope contacts and the housing contacts are implemented in the pressure-resistant-encapsulation or increased-safety ignition protection mode.

8. A luminaire according to claim 7 wherein the lamp envelope is filled with a gas.

9. A luminaire according to claim 1 wherein the lamp envelope consists at least partially of borosilicate glass.

10. A luminaire according to claim 1 wherein the luminaire housing has a reflector on the side facing the light exit opening.

11. A luminaire according to claim 1 wherein the lamp envelope has a reflector on a side located opposite the light exit opening.

12. A luminaire according to claim 1 wherein the illuminant is implemented as a manipulatable lamp module and the lamp envelope is suitable at least for the releasable insertion in the luminaire housing and has predetermined outer dimensions in the area of the envelope contacts.

13. A luminaire according to claim 2 wherein the illuminant is implemented as a manipulatable lamp module and the lamp envelope is suitable for releasable insertion in the luminaire housing and has predetermined outer dimensions at least in the area of the envelope contacts.

14. A luminaire according to claim 3 wherein the illuminant is implemented as a manipulatable lamp module and the lamp envelope is suitable for releasable insertion in the luminaire housing and has predetermined outer dimensions at least in the area of the envelope contacts.

15. A luminaire according to claim 1 wherein the shape of the lamp envelope is adapted to the shape of the lamp.

16. A luminaire according to claim 2 wherein the shape of the lamp envelope is adapted to the shape of the lamp.

17. A luminaire according to claim 1 wherein the envelope contacts and the housing contacts are implemented in the pressure-resistant-encapsulation or the increased-safety ignition protection mode.

18. A luminaire according to claim 2 wherein the envelope contacts and the housing contacts are implemented in the pressure-resistant-encapsulation or the increased-safety ignition protection mode.

19. A luminaire according to claim 3 wherein the envelope contacts and the housing contacts are implemented in the pressure-resistant-encapsulation or the increased-safety ignition protection mode.

20. A luminaire according to claim 4 wherein the envelope contacts and the housing contacts are implemented in the pressure-resistant-encapsulation or the increased-safety ignition protection mode.

21. A luminaire according to claim 5 wherein the envelope contacts and the housing contacts are implemented in the pressure-resistant-encapsulation or the increased-safety ignition protection mode.

22. A luminaire according to claim 1 wherein the lamp envelope is filled with a gas.

23. A luminaire according to claim 2 wherein the lamp envelope is filled with a gas.

24. A luminaire according to claim 3 wherein the lamp envelope is filled with a gas.

25. A luminaire according to claim 4 wherein the lamp envelope is filled with a gas.

26. A luminaire according to claim 5 wherein the lamp envelope is filled with a gas.

27. A luminaire according to claim 1 wherein the lamp envelope is implemented in the pressure-resistant-encapsulation or the increased-safety ignition protection mode.

28. A luminaire according to claim 1 wherein the lamp envelope is implemented such that it is able to accommodate lamps of different wattage.

29. A luminaire according to claim 1 wherein the illuminant is within an interior of the luminaire housing.

30. A luminaire according to claim 2 wherein the lamp envelope has a reflector on a side located opposite the light exit opening.

* * * * *